United States Patent [19]

Sawazaki

[11] Patent Number: 4,598,560

[45] Date of Patent: Jul. 8, 1986

[54] POSITIVE TYPE YARN FEEDING DEVICE FOR KNITTING MACHINE

[75] Inventor: Masatoshi Sawazaki, Kobe, Japan

[73] Assignee: Precision Fukuhara Works, Ltd., Kobe, Japan

[21] Appl. No.: 705,370

[22] Filed: Feb. 25, 1985

[30] Foreign Application Priority Data

Mar. 6, 1984 [JP] Japan ..... 59-43624

[51] Int. Cl.[4] ..... D04B 15/48

[52] U.S. Cl. ..... 66/132 T; 242/47.08

[58] Field of Search ..... 66/132 R, 132 T; 242/47.01, 47.08

[56] References Cited

U.S. PATENT DOCUMENTS

| | | | |
|---|---|---|---|
| 4,058,245 | 11/1977 | Hurt et al. | 66/132 R X |
| 4,147,311 | 4/1979 | Jordan | 242/47.08 X |
| 4,355,747 | 10/1982 | Vinas | 66/132 T X |

FOREIGN PATENT DOCUMENTS

| | | | |
|---|---|---|---|
| 2306404 | 8/1973 | Fed. Rep. of Germany | 66/132 R |
| 964455 | 1/1950 | France | 66/132 R |
| 951728 | 3/1964 | United Kingdom | 242/47.08 |
| 1192108 | 5/1970 | United Kingdom | 242/47.01 |
| 1044692 | 9/1983 | U.S.S.R. | 66/132 R |

*Primary Examiner*—Wm. Carter Reynolds

*Attorney, Agent, or Firm*—Bell, Seltzer, Park & Gibson

[57] ABSTRACT

The present yarn feeding device includes a rotating yarn feed wheel with at least one frictional yarn engaging and driving surface of predetermined width around the peripheral surface thereof, and yarn guides are provided for directing two runs of the yarn into engagement therewith. Movable yarn guides are provided for varying the degree of circumferential engagement of the individual runs of the yarn with the frictional yarn driving surface so that the degree of engagement is sufficient to cause the yarn to be fed when the knitting machine makes a demand for yarn and so that the degree of engagement is insufficient to cause the yarn to be fed when the knitting machine ceases to make a demand for yarn. A pair of manually movable yarn guide members is supported in spaced relationship from the outer circumference of the frictional yarn driving surface. The manually movable yarn guide members are manually adjustable in radial directions to vary the degree of circumferential contact between the individual runs of the yarn and the frictional yarn driving surface to permit yarns of different frictional characteristics to be fed by the yarn feeding device.

5 Claims, 8 Drawing Figures

POSITIVE TYPE YARN FEEDING DEVICE FOR KNITTING MACHINE

FIELD OF THE INVENTION

This invention relates generally to a self-actuating yarn feeding device for positively feeding yarns to a knitting machine, and more particularly to such a feeding device for use on stripe and jacquard type circular knitting machines.

BACKGROUND OF THE INVENTION

Usually, positive type tape-driven yarn feeding devices for circular knitting machines are provided with a plurality of yarn feed wheels driven by an endless drive tape which is driven in timed relationship to operation of the knitting machine. The yarns are fed by guide means in such a manner that they pass through the nip of the drive tape and the yarn feed wheels so as to positively feed the yarn in a continuous manner.

However, this continuous type of yarn feeding device is not adapted for use with knitting machines which require the selective feeding of a plurality of yarns according to variable demands from the knitting machine, such as is required in the operation of stripe and jacquard type circular knitting machines. This continuous type of yarn feeding device is not adaptable to use on stripe and jacquard circular knitting machines because the continuous yarn feeding device is not adaptable to the selective feeding of yarns, according to demand from the knitting machine, and in variable amounts, according to the knit structure.

It is also known to provide yarn feeding devices in which the yarns may be positioned in feeding and nonfeeding positions, depending upon the demand for yarn from the knitting machine. In this type of yarn feeding device the feed wheels are provided with a V-shaped groove and the tension in the yarn changes the position of contact between the yarn and the V-shaped groove in the feed wheel so that the yarn is positively fed when nipped between the tape and the feed wheel and feeding of the yarn is discontinued when the yarn is positioned in the V-shaped groove of the feed wheel. This type of feed device requires a high degree of precision for shaping the groove in the feed wheel and a fairly high degree of tension must be applied to the yarn to cause it to move out of the V-shaped groove and into feeding position on the feed wheel. Also, the range of yarn sizes which may be fed by this type of device is limited by the size and shape of the V-shaped groove and the groove may be easily worn due to contact with the yarn thereby causing expensive replacement of the feed wheels when they become worn.

Japanese patent publication No. 96941/1981 (United Kingdom published Application No. 2 065 723, published July 1, 1981) discloses another type of yarn feeding device which is operable with a stripe knitting machine for selectively feeding the striping yarns thereto. The yarn passes around this yarn feeding device with only a single run of a single wrap of about one hundred and eighty degrees and is provided with yarn guide means for varying the degree of contact between the yarn and the feed wheel so that the yarn assumes either a feeding or a nonfeeding position according to the demand for yarn by the knitting machine. However, tension in the yarn can become extremely high at the time the yarn is moved from the nonfeeding to the feeding position and the tension may become so high as to cause yarn breakage. Additionally, the yarn is not always smoothly transferred from the nonfeeding to the feeding position in accordance with the direction of twist in the yarn (S or Z twist). Furthermore, some types of yarn, such as filament polyester or nylon yarn have a tendency to stick to the frictional surface of the feed wheel and these yarns are difficult to separate from the friction surface when being moved from the feeding to the nonfeeding position so that overfeeding of the yarn may result and the yarn becomes wound around the feed wheel.

SUMMARY OF THE INVENTION

With the foregoing in mind, it is an object of the present invention to provide a self-actuating yarn feeding device which is operable with stripe and jacquard type circular knitting machines and which operates effectively to vary the degree of contact between the yarn and the yarn feed wheels in response to tension resulting from demand for yarn by the knitting machine and which does not include the disadvantages of the prior types of yarn feeding devices.

The yarn feeding device of the present invention further includes yarn guide means for providing for two individual runs of a double wrap of the yarn extending around or encircling at least three hundred and sixty degrees, and preferably about five hundred and forty degrees, of the feed wheel and with the individual runs being maintained in spaced-apart locations on the width of a part of the circumference of the feed wheel. This arrangement of the yarn prevents highly variable amounts of tension from being placed on the yarn when being moved between feeding and nonfeeding positions.

The yarn feeding device of the present invention includes a driving wheel with an endless tape being driven by the knitting machine and in driving engagement with the driving wheel. At least one, and preferably two, yarn feed wheels are rotated by the driving wheel and each of the feed wheels includes a frictional yarn driving surface of predetermined width around the peripheral surface thereof. Yarn guide-in means is provided for directing yarn inwardly on one side of the yarn feed wheel and into circumferential engagement with a given location on the width of the frictional driving surface. Movable yarn guide means, including an oscillating arm, is supported for limited pivotal movement in spaced relationship outwardly from the frictional yarn driving surface and includes a pair of vertically spaced yarn guides engageable by individual runs of a double wrap of the yarn around the frictional yarn driving surface. The movable yarn guide means is operable in response to tension in the yarn to vary the degree of circumferential contact between the yarn and the frictional yarn driving surface between about ninety and one hundred eighty degrees so that the degree of contact between the yarn and the frictional yarn driving surface is sufficient to cause the yarn to be fed when the knitting machine makes a demand for yarn. Also, the degree of contact between the yarn and the frictional yarn driving surface is insufficient to cause the yarn to be fed when the knitting machine ceases to make a demand for yarn.

A pair of manually movable yarn guide members is supported in spaced relationship from the outer surface of the frictional yarn driving surface and these manually movable yarn guide members are spaced from each other and from the movable yarn guide means. The manually movable yarn guide members are manually adjustable to vary the degree of circumferential contact between the individual runs of the yarn and the frictional yarn driving surface to permit yarns of different frictional characteristics to be fed by the yarn feeding device. Yarn guide means is provided at different vertical levels on each of the manually adjustable yarn guide members, relative to the width of the frictional yarn driving surface, for maintaining a separation of the individual runs of the double wrap of the yarn in contact with vertically spaced circumferential portions of the frictional yarn driving surface and through the movable yarn guide means. Yarn guide-out means is provided for directing the yarn outwardly and away from the opposite side of the yarn feed wheel.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
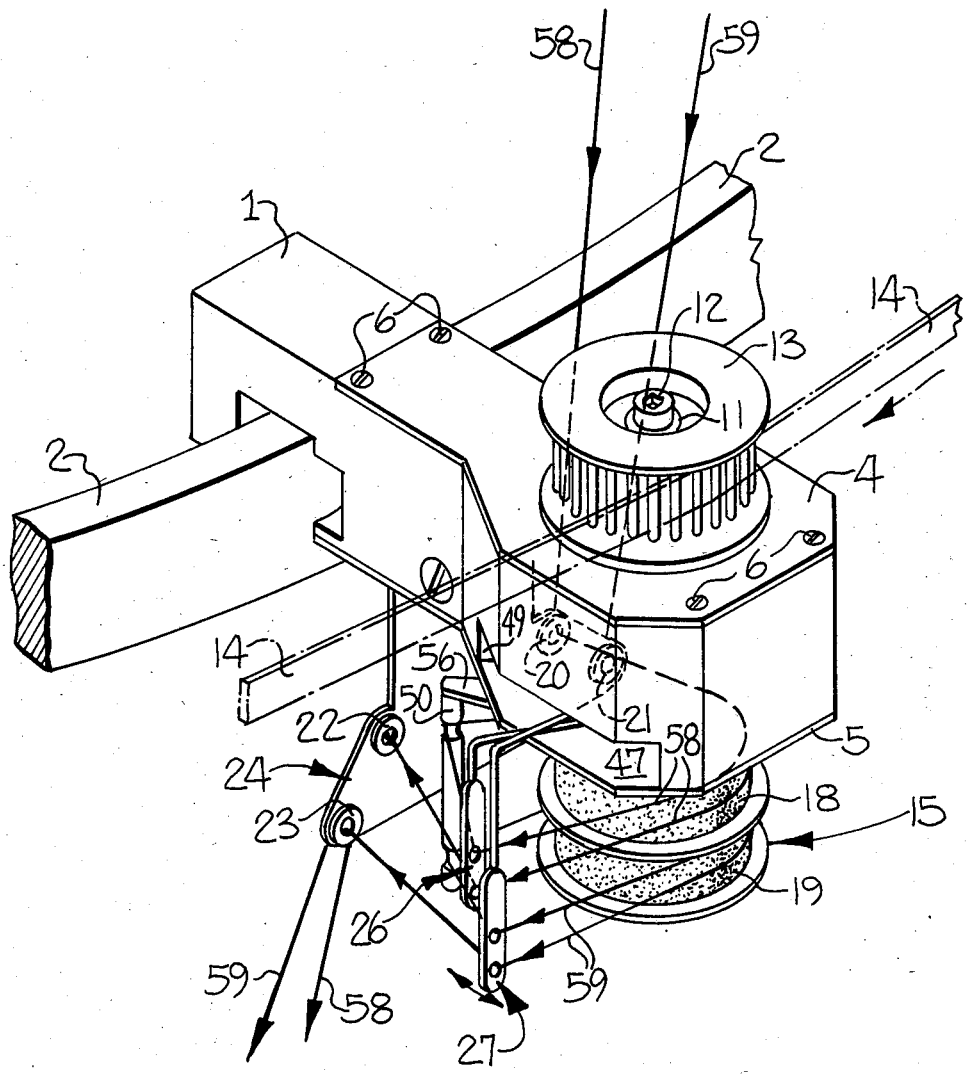
FIG. 1 is an isometric view of one of the yarn feeding devices of the present invention supported in adjusted position on a support rail of the knitting machine.
Figure 2:
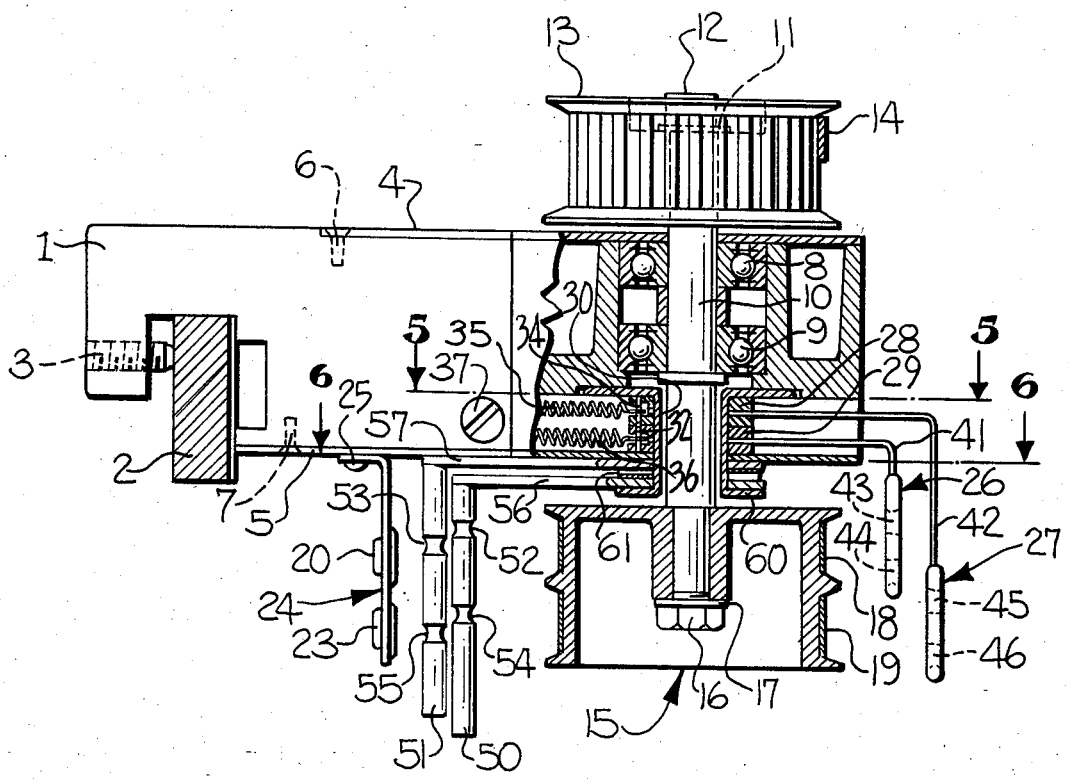
FIG. 2 is an elevational view of the left-hand side of the feeding device shown in FIG. 1, with parts in section.

As illustrated in FIGS. 1 and 2, the self-actuating and positive yarn feeding device of the present invention includes a housing 1 supported in adjusted position on a support ring 2 by means of a screw 3 (FIG. 2). The housing 1 is provided with an upper cover plate 4 and a lower cover plate 5 maintained in position thereon by respective screws 6 and 7. The front part of the housing 1 is provided with a vertical drive shaft 10 supported for rotation therein by upper and lower ball bearings 8 and 9. A driving wheel 13 is fixed to the upper end of the drive shaft 10 by means of a screw 12 and a washer 11 (FIG. 2). A large number of yarn feed housings 1 and driving wheels 13 are disposed in spaced-apart positions around and on the supporting ring 2 and an endless tape 14 extends around and in driving contact with the outer surface of each of the driving wheels 13. The endless drive tape 14 is driven in timed relationship with the knitting machine in a conventional manner.

Feed wheel means, broadly indicated at 15, is fixed on the lower end of the drive shaft 10 by means of a nut 16 and a washer 17 (FIG. 2) and is driven at the same speed as the driving wheel 13. At least one, and preferably two, frictional yarn driving surfaces of predetermined width, indicated at 18, 19, are provided on the peripheral surface of the yarn feed wheel means 15. The frictional yarn driving surfaces 18, 19 are preferably formed by a covering of antistatic material, such as a rubber band, and extend throughout the width and partially up the slanting opposite side surfaces. The rubber bands forming the frictional yarn driving surfaces 18, 19 provide good frictional contact between the yarn and the frictional yarn driving surfaces 18, 19.

Figure 3:
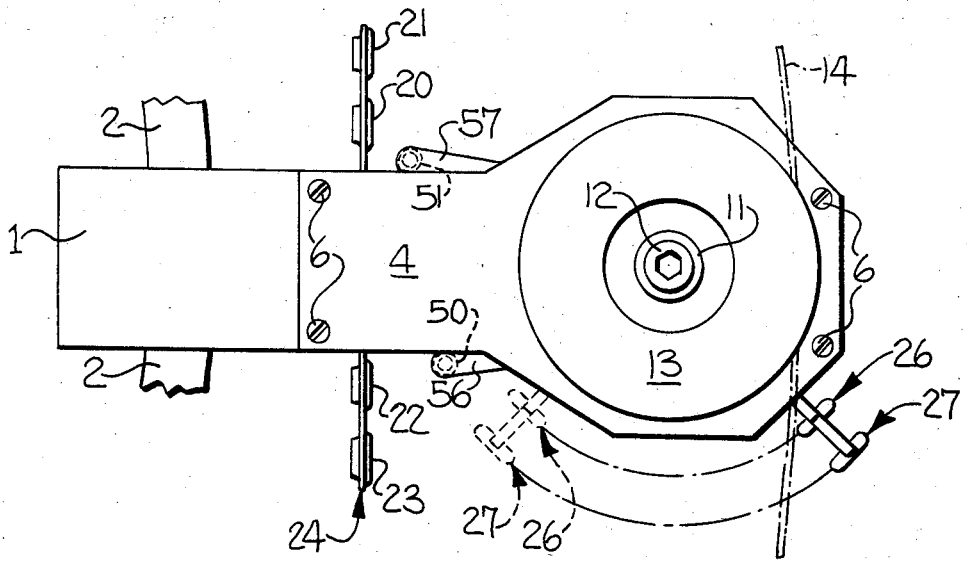
FIG. 3 is a plan view of the feeding device shown in FIG. 2.
Figure 4:
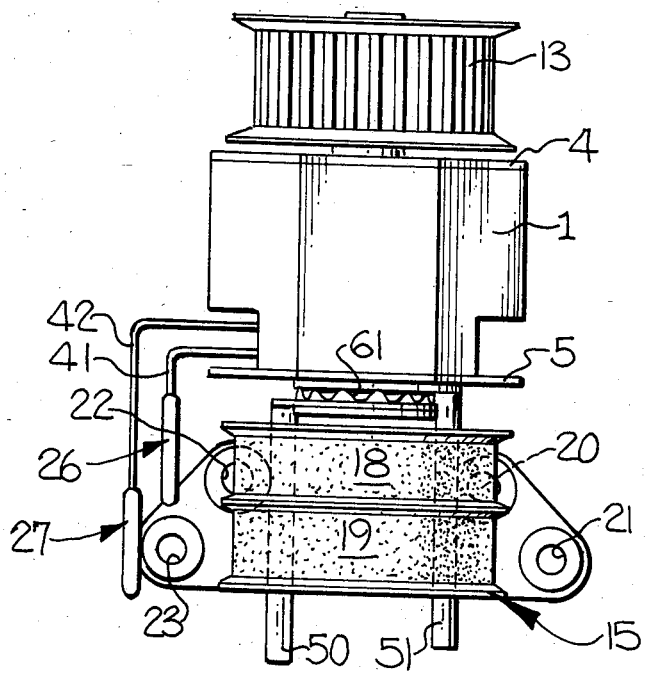
FIG. 4 is a front elevational view of the feeding device.
Figure 7:
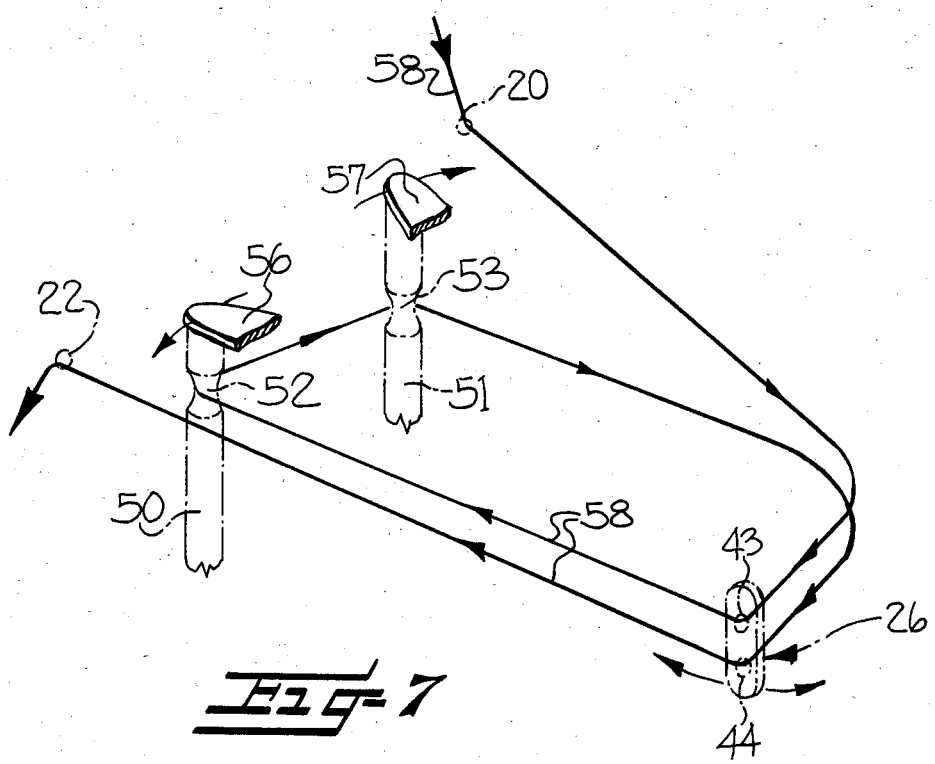
FIG. 7 is a schematic isometric view illustrating the manner in which one yarn is guided into and away from the feeding device and forms a double wrap around a portion of the circumference of the frictional driving surface, not shown.
Figure 6:
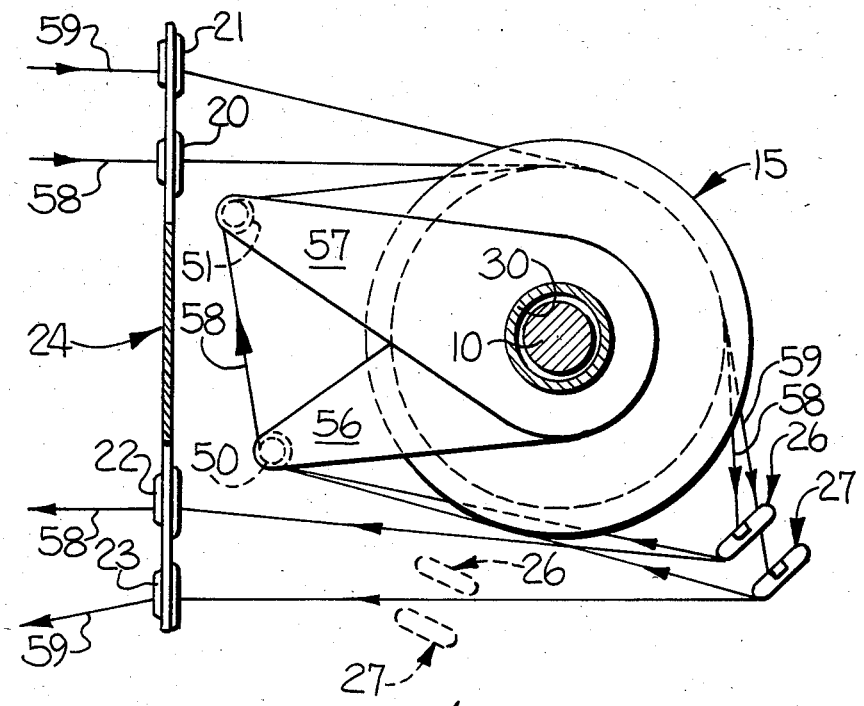
FIG. 6 is a fragmentary horizontal sectional view taken substantially along the line 6—6 in FIG. 2.
Figure 8:
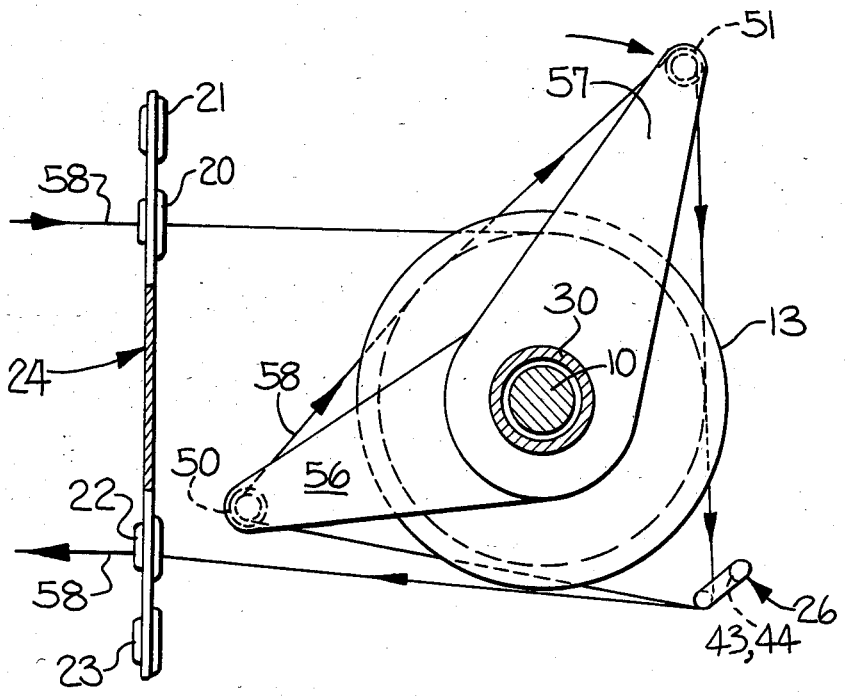
FIG. 8 is a view similar to FIG. 6 but illustrating one of the manually adjustable yarn guide members being moved to a different position to reduce the amount of frictional contact with the circumference of the yarn feeding wheel.

A stationary yarn guide plate, broadly indicated at 24, is fixed to the lower cover plate 5 with screws 25 (FIG. 2) and extends from the yarn entrance side to the yarn exit side, as illustrated in FIGS. 3, 6 and 8. Yarn guide-in means, in the form of yarn guide eyelets 20, 21, is supported in the entrance side of the yarn guide plate 24 for directing yarn inwardly on one side of the yarn feed wheel means 15 and into circumferential engagement with a given location on the width of the corresponding frictional yarn driving surfaces 18, 19. Yarn guide-out means, in the form of a pair of yarn guide eyelets 22, 23, is supported in the exit side of the yarn guide plate 24 for directing the yarn outwardly and away from the opposite side of the yarn feed wheel means 15.

Figure 5:
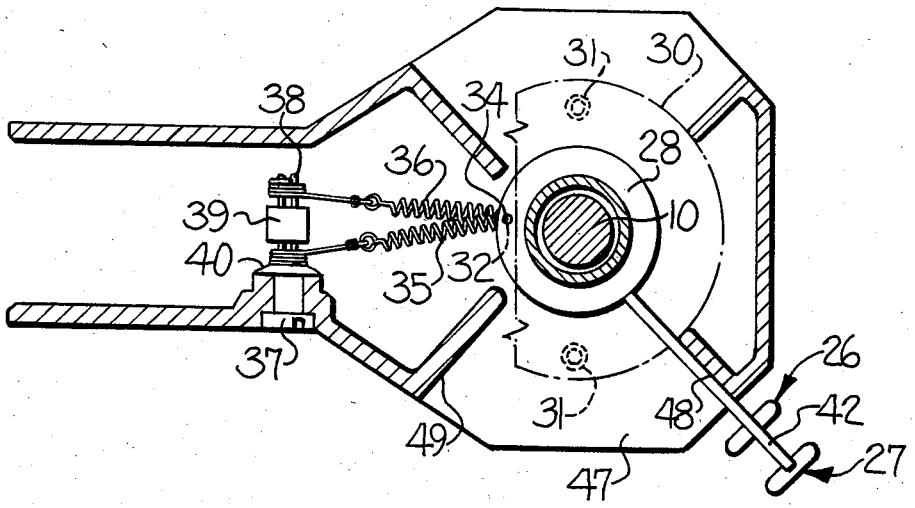
FIG. 5 is a fragmentary horizontal sectional view taken substantially along the line 5—5 in FIG. 2.

Movable yarn guide means, broadly indicated at 26, 27, is supported for limited pivotal movement in spaced relationship outwardly from the frictional yarn driving surfaces 18, 19 and is operable to vary the degree of circumferential contact between the yarn and the frictional yarn driving surfaces so that the degree of contact between the yarn and the frictional yarn driving surfaces is sufficient to cause the yarn to be fed when the knitting machine makes a demand for yarn and so that the degree of contact between the yarn and the friction yarn driving surfaces is insufficient to cause the yarn to be fed when the knitting machine ceases to make a demand for yarn. The movable yarn guides 26, 27 are supported by respective rings 28, 29 (FIG. 2) which surround and are rotatably supported by a bearing 30 fixed to the housing 1 by screws 31, as illustrated in FIG. 5.

Cutouts 32 are formed on the inner surfaces of the rings 28, 29 and pins 34 are mounted in the cutouts 32 and have the forward ends of tension springs 35, 36 (FIG. 5) fixed thereto. The rearward ends of the springs 35, 36 are connected to nylon threads or the like wound around and connected to the spindle portions of a rotatable control pin 37 supported in the housing 1. Slots 38 are provided in the pin 37 for retaining the inner ends of the nylon threads in fixed position on the adjustment pin 37. A collar 39 is supported on the control pin 37 and between the nylon threads to prevent them from overlapping each other. Axial movement of the control pin 37 is prevented by a resilient washer 40. The control pin 37 is provided for adjustment of the tension springs 35, 36 and may be rotated to increase or decrease the tension in the springs 35, 36, depending upon the frictional characteristics of the yarn to be fed by the yarn feeding device.

As best shown in FIG. 2, the movable yarn guide means 26 is provided with a short oscillating support arm 41 supporting the movable yarn guide means 26 in alignment with the frictional yarn guiding surface 18 while a long oscillating support arm 42 supports the yarn guide means 27 in alignment with the frictional yarn guide surface 19. The yarn guide means 26 is provided with an upper yarn guide opening 43 and a lower yarn guide opening 44. The yarn guide means 27 is provided with an upper yarn guide opening 45 and a lower yarn guide opening 46. As shown in FIG. 5, the movable yarn guide means 26, 27 are supported for limited pivotal movement in an opening 47 formed in the housing 1 and their pivotal range of movement is limited by corresponding end walls 48, 49.

As shown in FIGS. 2 and 8, a pair of manually movable yarn guide members 50, 51 is supported in spaced relationship from the outer circumference of the frictional yarn driving surfaces 18, 19. The movable yarn guide members 50, 51 comprise vertically extending guide rods extending downwardly and in parallel relationship with the axis of rotation of the yarn feed wheel means 15. The manually movable yarn guide members 50, 51 are provided with respective upper yarn guide grooves 52, 53 which are positioned in staggered relationship from each other and are aligned with the width of the upper frictional yarn driving surface 18, and respective lower yarn guiding grooves 54, 55 which are also staggered relative to each other and are aligned with the width of the lower frictional yarn driving surface 19. The grooves 52–55 are U or V-shaped in cross section and are engaged by the yarn to maintain the vertical position of the individual runs of the double wrap of the yarn at different locations on the width of the frictional yarn driving surfaces to prevent the yarns from overlapping each other. For ease of threading the yarn on the feed wheel means 15, the yarn guide members 50, 51 extend longitudinally downwardly beyond the lower surface of the feed wheel means 15, as shown in FIG. 2.

The respective manually movable yarn guide members 50, 51 are supported at their upper ends in the outer ends of a short support arm 56 and a long support arm 57, and the inner ends of the support arms 56, 57 extend around the bearing 30 surrounding the drive shaft 10. The upper ends of the manually movable yarn guide members 50, 51 may be supported in a fixed position on the support arms 56, 57 or they may be supported for rotation thereon. The inner ends of the support arms 56, 57 are supported for manually adjusted rotation between the lower cover plate 5 and the lower end plate 60 of the lower end of the bearing 30. A resilient washer 61 is supported between the inner ends of the support arms 56, 57 so that the support arms 56, 57 will remain in the manually adjusted rotatable position placed by an operator.

As will be noted, the manually movable yarn guide members 50, 51 are spaced from each other and from the movable yarn guide means 26, 27 and are manually adjustable in circumferential directions to vary the degree of circumferential contact between the individual runs of the yarn and the frictional yarn driving surface of the yarn feed wheel means 15 to permit yarns of different frictional characteristics to be fed by the yarn feeding device. By manually adjusting the circumferential position of the manually movable yarn guide members 50, 51, the degree of contact between the yarn and the frictional yarn driving surfaces of the yarn feed wheel means 15 is varied, depending upon whether a greater or lesser degree of frictional contact is required, according to the frictional characteristics of the yarn being fed to the knitting machine.

A single yarn 58 may be threaded through the yarn guide-in eyelet 20 and to the yarn feeding device in the manner illustrated in FIG. 8 with the first run of the double wrap of the yarn being in frictional contact with the feed wheel means 15 throughout approximately a 90-degree arc before passing through the movable yarn guide means 26. The yarn 58 then passes around the manually movable yarn guide member 50 and the movable yarn guide member 51, which has been rotated in a clockwise direction from that shown in FIG. 6. The yarn 58 then passes through the movable yarn guide means 26 and out the guideout eyelet 22 so that the second run of the yarn moves along a triangular path of travel and just barely contacts the feed wheel means 15 at three locations. In this position, the movable yarn guide means 26 is in the nonfeeding position and when a demand for yarn from the knitting machine is received, the movable yarn guide means 26 moves to the dotted line position shown in FIG. 6 so that the yarn is in frictional contact with the feed wheel throughout substantially 180 degrees of the feed wheel and the yarn then begins to feed.

When used on a striping machine, the yarn feed device is threaded in the manner illustrated in FIGS. 1 and 6 and with yarns 58 and 59 being alternately fed to the knitting machine during the formation of stripe knit fabric. In this operation, the manually movable yarn guide members 50, 51 are positioned as shown in FIG. 6 and the yarn 58 is directed inwardly through the yarn guide-in eyelet 20 and into circumferential engagement with a given location on the width of the frictional yarn driving surface 18, passes through the upper yarn guide hole 43 of the movable yarn guide 26, passes over the grooves 52, 53 of the manually movable yarn guide members 50, 51, again in circumferential engagement with a lower location on the frictional yarn driving surface 18, through the lower yarn guide hole 44 of the movable yarn guide 26, and outwardly and away from the opposite side of the yarn feed wheel means 15 and through the guide-out eyelet 22 to the needles of the circular knitting machine.

The yarn 59 is threaded through the guide-in yarn eyelet 21 and inwardly on one side of the yarn feed wheel means 15 and into circumferential engagement with a given location on the width on the frictional yarn driving surface 19. The yarn 59 is then directed through the upper hole 45 of the yarn guide 27, around the manually movable yarn guide members 50, 51, into circumferential engagement with the frictional yarn driving surface 19 at a lower location than the first run of the yarn, through the lower yarn guide hole 46 of the movable yarn guide 27 and outwardly and away from the opposite side of the yarn feed wheel means 15 and through the yarn guide-out eyelet 23 to the knitting machine.

When in the solid line position shown in FIG. 6, both of the movable yarn guide means 26, 27 are in the nonfeeding position and both runs of the yarns 58, 59 are in circumferential engagement with approximately 90 degrees of the peripheral surface of the corresponding frictional yarn driving surfaces 18, 19, so that the yarns 58, 59 are not being fed to the knitting machine. When the knitting machine alternately makes demands for the yarns 58, 59, as during a striping operation, the tension in the yarn being fed, for example, yarn 59, will increase to move the movable yarn guide means 27 to the dotted line position shown in FIG. 6 so that both runs of the double wrap of the yarn 59 is in circumferential engagement with approximately 180 degrees of the corresponding frictional yarn driving surface 19 so that the yarn is positively fed by the feed wheel means 15 while the movable yarn guide 26 remains in the nonfeeding position and the yarn 58 is not fed to the knitting machine.

When feeding and knitting of the yarn 59 ceases and yarn 58 begins to knit, the tension in the yarn 58 will increase to move the yarn guide 26 to the dotted line position so that both runs of the yarn 58 are moved into circumferential engagement with substantially 180 degrees of the peripheral surface of the frictional yarn driving surface 18 to begin to positively feed the yarn 58 to the knitting machine. When the requirement for the yarn 58 ceases, tension in the yarn relaxes and the movable guide 26 is returned to the initial nonfeeding solid line position shown in FIG. 6 and the degree of contact between both runs of the yarn and the frictional yarn driving surface 18 is reduced to approximately 90 degrees so that the yarn 58 is no longer positively fed to the knitting machine.

The yarn feeding device of the present invention may be circumferentially adjusted by moving the manually movable yarn guide members 50, 51 to vary the degree of contact between both runs of the yarns 58, 59 and the frictional yarn driving surfaces in accordance with the frictional characteristics of the particular type of yarn being fed to the knitting machine. After the proper adjustment of the manually movable yarn guide members 50, 51, the yarns are automatically fed to the knitting machine in accordance with the demands for yarn by the knitting machine by automatic movement of the movable yarn guide means 26, 27 between feeding and nonfeeding positions. Because of the manner in which the yarns are wound around the feed wheels in a discontinuous manner, that is, over the manually movable yarn guide members 50, 51, the yarn is easily separated from the frictional yarn driving surfaces when the demand for yarn decreases and the tension decreases so that the yarn does not have a tendency to wind up on the feed wheel, as has been the case in the prior art feed devices where the yarn is continuously wound about the feed wheel.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A positive type yarn feeding device for a circular knitting machine, said yarn feeding device including rotating yarn feed wheel means rotated by said driving wheel and including at least one frictional yarn driving surface of predetermined width around the peripheral surface thereof, yarn guide means adapted for directing two turns of a double wrap of the yarn into engagement with vertically spaced arcuate portions of said frictional yarn driving surface as the yarn is fed through said yarn feeding device, said yarn guide means including yarn guide-in means for directing yarn inwardly on one side of said yarn feed wheel and into circumferential engagement with a given location on the width of said frictional yarn driving surface, movable yarn guide means supported for limited pivotal movement in spaced relationship outwardly from said frictional yarn driving surface and including a pair of vertically spaced yarn guide means engageable by the two turns of the yarn around said frictional yarn driving surface, said movable yarn guide means being operable to vary the degree of circumferential contact between the two turns of the yarn and said frictional yarn driving surface so that the degree of contact between the yarn and said frictional yarn driving surface is approximately 180 degrees and is sufficient to cause the yarn to be fed when said knitting machine makes a demand for yarn and so that the degree of contact between the yarn and said frictional yarn driving surface is approximately 90 degrees and is insufficient to cause the yarn to be fed when said knitting machine ceases to make a demand for yarn, a pair of manually movable yarn guide members supported in spaced relationship from the outer circumference of said frictional yarn driving surface, a pair of support arms having one end supported for pivotal movement about the rotational axis of said yarn feed wheel means and supporting said movable yarn guide members on the outer ends thereof, one of said support arms being longer than the other of said support arms, said manually movable yarn guide members being spaced from each other and from said movable yarn guide means and being manually adjustable in circumferential directions to vary the degree of circumferential contact between individual turns of the yarn and said frictional yarn driving surface both when said knitting machine makes a demand for yarn and when said knitting machine ceases to make a demand for yarn and to thereby permit yarns of different frictional characteristics to be fed by said yarn feeding device, and yarn guide-out means for directing the yarn outwardly and away from the opposite side of said yarn feed wheel.

2. A positive type yarn feeding device according to claim 1 wherein said manually adjustable yarn guide members each include yarn guide means at different vertical levels relative to the width of said frictional yarn driving surface for maintaining a separation of the individual turns of the double wrap of the yarn around said frictional yarn driving surface and through said movable yarn guide means.

3. A positive type yarn feeding device according to claim 2 wherein said movable yarn guide members comprise vertically extending guide rods, and wherein said yarn guide means at different vertical levels thereon comprise yarn guiding grooves formed therein.

4. A positive type yarn feeding device according to claim 3 wherein the upper ends of said guide rods are supported in a vertical position on said support arms for pivotal movement above said yarn feed wheel means, and wherein the lower ends of said vertically extending guide rods extend downwardly beyond the lower surface of said yarn feed wheel means.

5. A positive type yarn feeding device according to claim 1 wherein said yarn feed wheel means includes a pair of frictional yarn driving surfaces for selectively driving a pair of separate yarns to the knitting machine.

* * * * *